US005750205A

United States Patent [19]

Shashkovsky et al.

[11] Patent Number: 5,750,205

[45] Date of Patent: May 12, 1998

[54] SURFACE TREATMENT OF METALS BY SHOCK-COMPRESSED PLASMA

[75] Inventors: Sergei Gennadievich Shashkovsky; Alexander Semyonovich Kamrukov, both of Moscow; Dmitry Vyacheslavovich Chepegin, Nizhnekamsk; Victor Vladimirovich Bandurkin, Moscow, all of U.S.S.R.

[73] Assignee: Woodford Trading Limited, Jersey, Channel Islands

[21] Appl. No.: 509,866

[22] Filed: Aug. 1, 1995

[30] Foreign Application Priority Data

Aug. 3, 1994 [SU] U.S.S.R. ..... 94028267

[51] Int. Cl.[6] ..... B05D 3/06

[52] U.S. Cl. ..... 427/535; 427/533; 148/903

[58] Field of Search ..... 427/569, 533, 427/535; 148/903

[56] References Cited

U.S. PATENT DOCUMENTS 3,615,924 10/1971 Swoboda et al. .

FOREIGN PATENT DOCUMENTS 268374A 5/1985 German Dem. Rep. .
1765104 7/1971 Germany .
2449712 7/1976 Germany .
63-053213 3/1988 Japan .
63-211543 9/1988 Japan .
3-171598 7/1991 Japan .
5-065530 3/1993 Japan .
5-125569 5/1993 Japan .
1668418 8/1991 U.S.S.R. .
WO9323587 11/1993 WIPO .

OTHER PUBLICATIONS

Document Number IEEE 2755934 Jul.–Aug. 1985 USA/Soviet Union.

Tomashov et al. Zashch. Met., 24(3), pp. 395–400 (Russian) 1988. (Abstract only).

Baimbetov et al. Izv. Akad. Nauk Kaz. SSR. Ser. Fiz.–Mat.(2), 5–8 (Russian)1989 (Abstract only).

*Primary Examiner*—Roy V. King

*Attorney, Agent, or Firm*—Hopgood, Calimafde, Kalil & Judlowe

[57] ABSTRACT

A method for surface treating a metallic substrate to enhance its corrosion resistance. The method comprises the step of applying to the surface of the substrate a pulse treatment with a beam of dense high-temperature radiation generated by a coaxial plasma accelerator of the erosion type. The method provides for rapid heating of the surface region of the substrate to modify its metallurgical structure, without substantial heating of the underlying bulk thereof, followed by rapid cooling, whereby crystal nucleation and growth are suppressed and phase segregation and separation of substrate additives or compounds is avoided.

3 Claims, No Drawings

SURFACE TREATMENT OF METALS BY SHOCK-COMPRESSED PLASMA

This invention relates generally to the surface treatment of metals, particularly various types of steel, to improve corrosion resistance.

It is known that steel substrates, even treated substrates of the so-called "stainless" type, are vulnerable to environmental corrosion which, ultimately, can cause the substrate to degrade to such an extent that total failure ensues. Conventional attempts to solve this problem include (i) providing a protective surface layer on the substrate to prevent contact between the substrate and its immediate environment, (ii) treatment of the immediate environment to render it less corrosively aggressive, and (iii) treatment of the steel itself to increase its inherent resistance to corrosive attack.

An example of a protective surface layer, particularly when the substrate is intended to be painted, is a phosphate coating over which a coat of primer is usually applied before the topcoat is applied. An example of treatment of the substrate is the incorporation of alloying ingredients to enhance corrosion resistance. Stainless steel is an example of such a material. However, penetrative corrosive attack is still possible along grain boundaries, particularly following high-temperature heat treatment or welding.

Other methods of protection known in the art include modification of the surface structure of the substrate material by nitriding, high temperature heat treatment and laser beam treatment. However, these methods have been found either expensive, inefficient, or limiting in treating only small localized areas or parts. Laser beam treatment additionally requires a complex system of focusing the beam on the substrate. A further disadvantage is low absorption of radiation by the substrate material. Broad-beam pulse treatment is also known, typically using ultra-violet radiation from quartz discharge lamp sources, but such lamps suffer from a restricted power output, typically in the range $10^4$–$10^5$ W·cm$^2$. This has been found insufficient for the formation of the ultra-fine grain structure necessary for effective corrosion resistance. High-energy ion bombardment may also be used, usually generated by a coaxial plasma accelerator using a feed of pulsed gas, typically hydrogen or helium. However, limitations of operational parameters in terms of pressure and voltage restrict the depth of the modified surface structures produced.

It is therefore an object of the present invention to provide a method for improving the corrosion resistance of metal, particularly steel, substrates by modification of their surface structure to avoid problems associated with known methods.

In accordance with one aspect of the present invention is a method for surface treating a metal substrate to enhance its corrosion resistance, which comprises the step of pulse treating the substrate surface with a beam of dense high-temperature radiation generated by a coaxial plasma accelerator of the erosion type. Preferably, the plasma accelerator is operated under conditions whereby the radiation beam is self-focused.

In accordance with another aspect of the present invention is a metallic substrate treated by a method which comprises the step of applying to the surface of the substrate a pulse treatment with a beam of dense high-temperature radiation generated by a coaxial plasma accelerator of the erosion type.

By "coaxial plasma accelerator of the erosion type" is generally meant an accelerator including coaxial anode and cathode separated by a dielectric plug the material of which serves to generate the plasma, the discharge current being derived from a capacitor power storage bank.

In such accelerators, plasma having the required properties is generated by injection of the initial portion of plasma into the interelectrode space, giving rise to discharge of the previously-charged capacitor bank on the electrodes. A small portion of the dielectric plug is thereby evaporated and the resulting vapor is ionized and heated by the discharge current. The plasma is accelerated along the electrodes, axial acceleration being influenced by interaction of radial components of the discharge current with the azimuthal component of the magnetic field. Thus, as a consequence of the Hall effect, and interaction of the longitudinal Hall effect current with the azimuthal magnetic field, the electromagnetic force which draws the accelerating plasma towards the cathode includes a radial component which compresses the plasma beam towards the accelerator axis. This focuses a part of the plasma flux longitudinally. The accelerated plasma beam is thereby focussed externally of the accelerator and a compact area of shock-compressed plasma (or "plasma focus") is generated. The shock-wave mechanism effectively avoids loss of energy in more conventional methods of plasma heating and enables efficient production of high-energy radiation with the required power characteristics.

The foregoing discussion is provided for purposes of illustration and is not intended to limit the intended application or environment of the present invention. The remaining structural and functional aspects of plasma accelerators are known by those skilled in the art and further description is believed unnecessary for illustration of the present invention.

Preferably, in order to provide optimum surface structure for enhanced corrosion resistance, the method according to the present invention is carried out under conditions of power current density of $10^5$–$10^7$ W·cm$^{-2}$ of surface under treatment for a time period between $10^{-5}$ to $3\times10^{-4}$ s. These conditions enable an ultra-fine grain structure to be produced at the surface of the metal substrate to a depth of up to approximately 50 microns, thereby providing enhanced corrosion resistance. At treatment times longer than $3\times10^{-4}$ s, an increase in the thickness of the surface treatment zone is achieved but the grain structure is coarser. Hence, the corrosion resistance is not significantly affected. Furthermore, transitional zones may be formed between the surface structure and the underlying bulk of the substrate, resulting from high-temperature tempering. This is undesirable. At current densities less than $10^5$ W·cm$^{-2}$, the required ultra-fine grain structure is not achieved, whereas at densities greater than $10^7$ W·cm$^{-2}$ considerable overheating of the melt occurs, accompanied by growth of hydrodynamic instability, evaporation and melt splashing. The optimum combination of current density and treatment time depends on the chemical nature of the substrate material and its physical heat properties.

The chemical nature of the gaseous atmosphere has been found immaterial and the preferred pressure thereof is generally within a range of 1 to $10^5$ Pa. The operative voltage for an accelerator of the erosion type is relatively low, typically from about 800V up to about 5 KV. This represents an advantage over accelerators of the gas type.

Generally speaking, the method of the present invention provides rapid heating of the surface region of the substrate to modify its metallurgical structure, without substantial heating of the underlying bulk of the substrate, followed by rapid cooling at a rate of approximately $10^6$–$10^7$ K/s. Under such conditions, crystal nucleation and growth are suppressed and phase segregation and separation of substrate additives or components is avoided; as a result a frozen metastable solid solution is obtained at the substrate surface, having a high degree of homogeneity.

The invention will now be further illustrated by the following examples, which are not meant to limit the scope of this disclosure.

EXAMPLE 1

Samples of low-carbon steel were pulse treated at a pressure of 1 Pa by radiation from the plasma focus zone of a coaxial plasma accelerator of the erosion type.

The parameters of the radiation beam were as follows:

time–$2\times10^{-4}$ s current density–$5\times10^{5}$ W·cm$^{-2}$

The structure of the resulting modified layer was that of an ultra fine-grain dispersion of low-carbon martensite. The depth of the layer was 10–20 microns. The change in corrosion resistance was evaluated according to the current of self-dissolution of the samples during tests in a standard three-electrode cell of synthetic sea water under various conditions of electrolyte aeration.

The results are shown in the following table:

| | Degree of Aeration | | | |
|---|---|---|---|---|
| | Min | Small | Medium | Large |
| Dissolution current (treated samples) 1 uA/cm$^2$ | 0.17 | 0.96 | 9.2 | 23.0 |
| Dissolution current (untreated control samples) 1 uA/cm$^2$ | 1.1 | 4.5 | 22.0 | 26.0 |
| Ratio of increase in corrosion resistance (control/treated) | 6.5 | 4.7 | 2.4 | 1.1 |

The change in corrosion resistance is related to the change in grain size of the treated zone. The most significant increases are observed under conditions of low aeration of the electrolyte, that is, when the quantity of dissolved oxygen is relatively small.

EXAMPLE 2

Samples of 06×13 T steel (13% Cr) were treated by pulse plasma under a pressure of 1 Pa by a plasma current obtained by a coaxial plasma accelerator of the erosion type. The parameters of heat flow and the method of evaluation of corrosion resistance are analogous to those of Example 1.

The carbide phase does not exist in the structure of the obtained modified layer, and crystallization is partial.

The treated samples spontaneously adopted the passive state with dissolution currents close to those for 08×18 T steel (18% Cr). For untreated samples of 06×13 T steel, self-passivation was absent.

The improvement of passivation and the decrease of the self-dissolution current reflect a more uniform distribution of chrome and the increase of efficiency of the cathode process due to the increase in density of dislocations in the structure of the material after treatment.

EXAMPLE 3

Samples of 08×25 T steel and 08×25 H10 T steel were treated similarly to EXAMPLE 1.

In the resulting layer (the so-called "white" layer), a crystalline structure was not found. The possibility of suppression of the tendency to grain-boundary corrosion was studied. The tests were conducted according to the conditions specified by the State Standard of the USSR, 9.914-91. Untreated samples, after thermal treatment (annealing), showed a tendency to grain-boundary corrosion. After treatment, this tendency was fully suppressed.

Although the present invention is described in connection with various types of steel, it may be adapted for application to other materials, giving consideration to the purpose for which the present invention is intended.

Various modifications and alterations to the present invention may be appreciated based on a review of this disclosure. These changes and additions are intended to be within the spirit and scope of this invention as defined by the following claims.

What is claimed is:

1. A method for surface treating a metallic substrate to enhance its corrosion resistance, the method comprising the step of applying to the surface of the substrate a pulse treatment with a beam of intense high-temperature radiation generated by a coaxial plasma accelerator having a plasma focus, the power current density of the radiation beam being within a range of about $10^{5}$–$10^{7}$ W·cm$^{-2}$ of surface face under treatment, the pulse being within a range of about $10^{-5}$–$3\times10^{-1}$ s, the pressure of the gaseous atmosphere being within a range of about 1–$10^{5}$ Pa, the operating voltage of the accelerator being within a range of about 800V–5 KV, and the substrate comprising steel.

2. The method set forth in claim 1 wherein the plasma accelerator is operated under conditions whereby the radiation beam is self-focused.

3. The method set forth in claim 1 wherein the steel comprises stainless steel.

* * * * *